US006090244A

United States Patent [19]

Kotitschke

[11] Patent Number: 6,090,244

[45] Date of Patent: Jul. 18, 2000

[54] PRESS SECTION

[75] Inventor: Gerhard Kotitschke, Steinheim, Germany

[73] Assignee: Voith Sulzer Papiermaschinen GmbH, Heidenhem, Germany

[21] Appl. No.: 09/014,971

[22] Filed: Jan. 28, 1998

[30] Foreign Application Priority Data

Jan. 28, 1997 [DE] Germany ..... 297 01 382

[51] Int. Cl.[7] ..... D21F 3/04

[52] U.S. Cl. ..... 162/306; 162/358.3; 162/360.2

[58] Field of Search ..... 162/358.1, 306, 162/360.2, 358.3

[56] References Cited

U.S. PATENT DOCUMENTS

| | | | |
|---|---|---|---|
| 3,198,697 | 8/1965 | Justus | 162/360.2 |
| 3,861,996 | 1/1975 | Dortel | 162/358.1 |
| 4,483,745 | 11/1984 | Wicks et al. | 162/360.2 |
| 4,909,903 | 3/1990 | Mullner | 162/358.1 |
| 5,328,569 | 7/1994 | Cronin | 162/358.1 |
| 5,650,049 | 7/1997 | Kivimaa et al. | 162/360.2 |
| 5,762,761 | 6/1998 | Kivimaa et al. | 162/360.2 |

FOREIGN PATENT DOCUMENTS

| | | | |
|---|---|---|---|
| 0159280 | 10/1985 | European Pat. Off. . | |
| 0740017 | 10/1996 | European Pat. Off. . | |
| 29701382 | 4/1997 | Germany . | |
| 29800330 | 6/1998 | Germany . | |
| 8808051 | 10/1988 | WIPO | 162/360.2 |

*Primary Examiner*—Karen M. Hastings
*Attorney, Agent, or Firm*—Greenblum & Bernstein, P.L.C.

[57] ABSTRACT

Press section of a machine for manufacturing a fibrous pulp web. The press section includes at least one press nip for draining the fibrous pulp web and at least one continuous press felt positioned on each side of the fibrous pulp web. The at least one continuous press felts may be guided through the press nip. The press section also includes a transfer roll that transfers the fibrous pulp web from a belt of a prepositioned unit to one of the at least one continuous press felts and a suctioned guide roll arranged within a loop of the one continuous press felt and between the transfer roll and the press nip. The suctioned guide roll is adjustably positionable so that the at least one continuous press felt positioned opposite the one continuous press felt is at least tangential to the suctioned guide roll, and adjustable positioning of the suctioned guide roll adjusts/an intake angle of the web into the press nip.

21 Claims, 2 Drawing Sheets

PRESS SECTION

CROSS-REFERENCE OF RELATED APPLICATIONS

The present application claims priority under 35 U.S.C. § 119 of German Patent Application No. 297 01 382.3, filed Jan. 28, 1997, the disclosure of which is expressly incorporated by reference herein in its entirety.

BACKGROUND OF THE INVENTION

1. Field of the Invention

The invention relates to a press section of a machine for manufacturing a fibrous pulp web. The press section includes at least one press nip or opening for draining the fibrous pulp web, and at least one continuous press felt that runs through the press nip on both sides of the fibrous pulp web. The fibrous pulp web may be transferred to or received by a belt of a prepositioned unit via a transfer roll. At least one of continuous felts may be guided around the transfer roll.

2. Discussion of Background Information

A press section similar in generally to type discussed above has been disclosed in EP 0 159 280. The fibrous pulp web is received by a felt belt guided over a transfer roll. Another felt belt is guided directly behind the transfer roll to the fibrous pulp web so that the fibrous pulp web is guided between the two felt belts through a first press nip of an extended nip press. The fibrous pulp web is subsequently fed between two felt belts to a shoe press, and subsequently to a drying unit.

It has been shown that the above-noted prior art device has disadvantages that include an invariable and/or non-adjustable intake angle of the fibrous pulp web into the first press nip. Thus, the device is unable to compensate or adjust the intake angle accordingly for certain web conditions, e.g., surface weight, dry content, or fibrous material type. As a result, folds can occur in the fibrous pulp web, particularly when operating at high web running speeds. That is, folds may result depending upon the size of the intake gusset between the lower roll and the lower felt belt because the air in this intake gusset is pressed through the lower felt belt to the fibrous pulp web being guided or carried by the lower felt belt.

SUMMARY OF THE INVENTION

The present invention provides a press section in which an intake angle of the fibrous pulp web to the press nip may be varied.

The present invention provides a suctioned guide roll within a loop formed by press felt positioned to receive the fibrous pulp web from a transport belt. The suctioned guide roll may be located between a transfer roll and the press nip and is looped by the press felt. The suctioned guide roll is also positionable such that an opposing press felt of the press felt at least tangential to the suctioned guide roll.

Via the suctioned guide roll, which can be adjusted vertically, an intake angle of the fibrous pulp web into the press nip can be varied, in accordance with operating conditions, without difficulty. This enables the amount of air in the intake gusset between the press felt and press roll, and, thereby, the amount of air that can be pressed through the press felt to the fibrous pulp web to be controlled. Further, utilizing a suctioned guide roll the introduction of air into the intake gusset between press felt and guide roll.

In accordance with the present invention, it is advantageous if the press felt receiving the fibrous pulp web from a prepositioned unit, e.g., a wire former, winds around the guide roll at an angle of, e.g., between approximately 5° and 60°, and preferably between approximately 15° and 45°, and the opposing press felt winds around the guide roll at an angle of, e.g., between approximately 0° and 30°, and preferably between approximately 0° and 15°.

The above arrangement is particularly advantageous if the press nip is a first press nip of the press section and if the fibrous pulp web is received by a belt composed of a screen of a prepositioned former.

Because the second (i.e., opposing) press felt is guided to the fibrous pulp web on the press felt at a relatively short distance after the transfer roll, an oscillation or vibration of the press felts can be substantially avoided. Further, in instances where the press felt running above the fibrous pulp web receives the fibrous pulp web from the prepositioned unit, lifting off of the fibrous pulp web from the upper press felt may be substantially hindered.

A good, continued guiding of the fibrous pulp web, in particular at high speeds, is then attained if the press felt running under the fibrous pulp web, i.e., the lower press felt, transfers the fibrous pulp web to a subsequent unit.

The present invention is directed to a press section of a machine for manufacturing a fibrous pulp web. The press section includes at least one press nip for draining the fibrous pulp web and at least one continuous press felt positioned on each side of the fibrous pulp web. The at least one continuous press felts may be guided through the press nip. The press section also includes a transfer roll that transfers the fibrous pulp web from a belt of a prepositioned unit to one of the at least one continuous press felts and a suctioned guide roll arranged within a loop of the one continuous press felt and between the transfer roll and the press nip. The suctioned guide roll may be adjustably positionable so that the at least one continuous press felt positioned opposite the one continuous press felt is at least tangential to the suctioned guide roll.

In accordance with another feature of the present invention, the press nip may include a first press nip of the press section and the belt may be composed of a screen of a prepositioned former.

In accordance with another feature of the present invention, the one continuous press felt may be positioned above the fibrous pulp web to form an upper press felt.

In accordance with still another feature of the present invention, the opposite continuous press felt may be positioned below the fibrous pulp web to form a lower press felt and the lower press felt may be adapted to transfer the fibrous pulp web to a subsequent unit. Further, the press nip may include an elongated press nip and the elongated press nip may be formed between a shoe press roll and a cylindrical mating roll. Still further, the subsequent unit may include a second elongated press nip.

The present invention may be directed to a press section for a fibrous pulp web production machine. The press section may include a transfer roll, a press device, a first press felt, a second press felt being guided through the press device with the first press felt, and a suctioned guide roll positioned adjacent the first press felt to adjustably position the first press felt relative to the second press felt. The suctioned guide roll may be located between the transfer roll and the press device and the suctioned guide roll may be positionable such that the second press felt is at least tangential to the suctioned guide roll.

In accordance with another feature of the present invention, the press section may include a guide roll for the second press felt. The guide roll may be positioned ahead of the suctioned guide roll in a travel direction of the second press felt. Further, the guide roll may be positionably adjustable to vary a wrap angle of the second press felt around the suctioned guide roll.

In accordance with still another feature of the present invention, the press section may include a subsequent unit that includes a second press device, a third press felt, and a transport belt. The third press felt and the transport belt may be guided through the second press device.

In accordance with a further feature of the present invention, the transport belt may be a fourth press felt and the subsequent unit may include a positionable guide roll that guides the fourth press felt and adjusts the position of the fourth press felt relative to the third press felt. Further, at least one suction device may be positioned along the third press felt and located ahead of the second press device in a travel direction of the third press felt. Still further, a deflection roll may be positioned to separate the third press felt from the fourth press felt upon exiting the second press device.

In accordance with a still further feature of the present invention, the transport belt may be a water impermeable belt and the subsequent unit may include a second suctioned guide roll that guides the water impermeable belt upon exiting the second press device. Further, the third press felt and the water impermeable belt may be guided together between the second press device and the second suctioned guide roll. Still further, a deflection roll may be positioned to separate the third press felt from the water impermeable belt at the second suctioned guide roll.

In accordance with yet another feature of the present invention, at least one suction device may be positioned adjacent the third press felt ahead of the second press device, in a travel direction of the third press felt.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
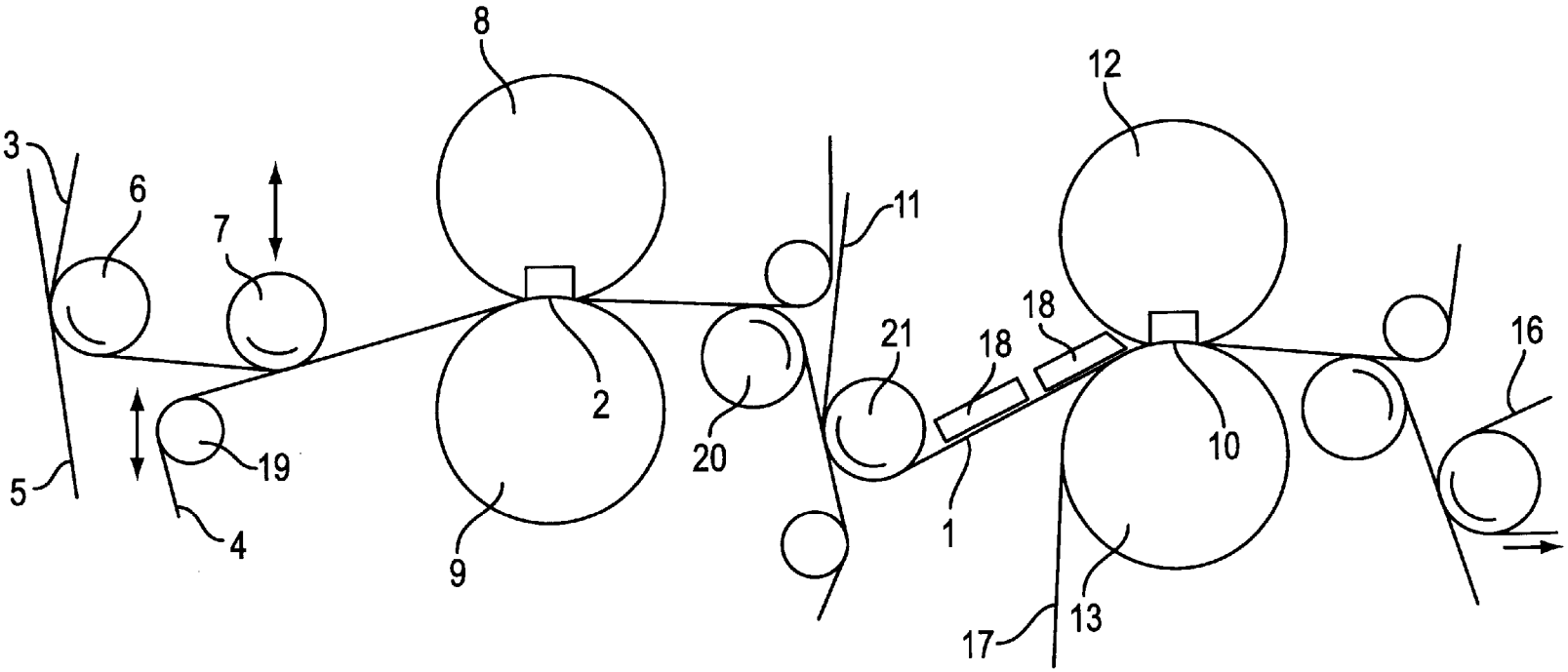
FIG. 1 illustrates a press section in accordance with the present invention in which a second press nip is composed of a double-felted second press nip.
Figure 2:
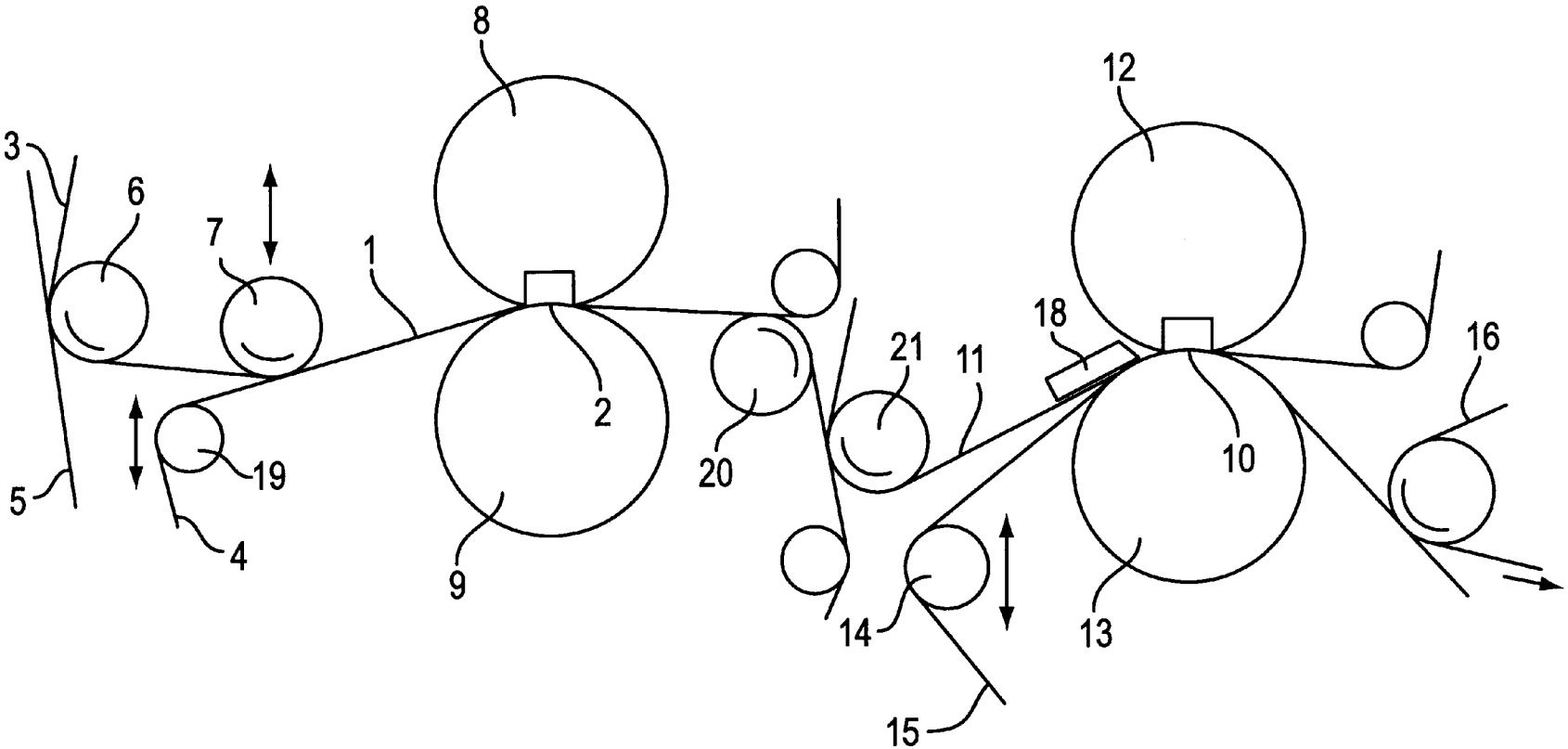
FIG. 2 illustrates a press section in accordance with the present invention in which the second press nip includes a press belt.

Referring to both FIGS. 1 and 2, a press section includes two press nips or openings 2 and 10 for draining a fibrous pulp web 1, e.g., a paper web, guided therethrough. Fibrous pulp web 1 may be guided through first press nip 2 between continuous press felts 3 and 4, which are guided through first press nip 1 on both (or opposite) sides of fibrous pulp web 1. Upper press felt 3 may be guided around (or loop) a suction transfer roll 6 to receive fibrous pulp web 1 carried on a belt 5. Belt 5, e.g., may be a screen of prepositioned former.

Between suction transfer roll 6 and first press nip 2, a suctioned guide roll 7, positioned within a loop formed by upper press felt 3, may be positioned to guide press felt 3. Suctioned guide roll 7 may be looped by upper press felt 3 at an angle of, e.g., approximately 30°, and may be vertically positionable, as indicated by the bidirectional arrow, to move upper press felt 3 relative to (i.e., toward or away from) an opposing or lower felt belt 4. Accordingly to the specific position of suctioned guide roll 7, upper press felt 3 may form a wrap angle around suctioned guide roll 7 of, e.g., between approximately 5° and 60° and preferably between 15° and 45°. Suctioned guide roll 7 is positionable so that lower press felt 4 is at least tangential to suctioned guide roll 7, however, a wrap angle of lower press felt 4 around suctioned guide roll 7 may be, e.g., between approximately 0° (i.e., tangential) and 30°, and preferably between approximately 0° and 15°. The specific angles depend upon the specific conditions of the fibrous pulp web, i.e., weight, moisture content, etc.

It may also be advantageous if a guide roll 19, which is located within a loop formed by lower press felt 4, and positioned ahead of suctioned guide roll 7 with regard to a run direction of lower press felt 4, is positionably adjustable vertically, as shown by the bidirectional arrow, and looped by lower press felt 4 to guide lower press felt 4. In this manner, variation of the belt wrap angle of lower press felt 4 around suctioned guide roll 7 may be achieved and a leading away of lower press felt 4 from the guide roll 7 may be provided under certain operating conditions.

In accordance with the features of the present invention, suctioned guide roll 7 enables adjustment of the intake angle of the fibrous pulp web 1 into first press nip 2 and removal, by suction, of the air introduced or present between upper press felt 3 and fibrous pulp web 1 from the intake gusset between upper press felt 3 and guide roll 7. As a result, fibrous pulp web 1 is held between, and guided by, the two press felts 3 and 4 into press nip 2 with at least a lower risk of forming folds, as compared to the prior art.

After first press nip 2, fibrous pulp web 1 may be separated from upper press felt 3 by a suctioned guide roll 20 positioned within, and looped by, lower press felt 4. In this manner, remoistening of fibrous pulp 1 is at least substantially avoided. First press nip 2 may be formed by a shoe press roll having a press shoe roll 8 arranged to exert pressure on the upper surface of fibrous pulp web 1 and a substantially cylindrical mating roll 9 positioned below the lower surface of fibrous pulp web 1. A transfer of fibrous pulp web 1 from lower press felt 4 to an upper press felt 11 of a subsequent press, e.g., formed by a shoe press having a press shoe roll 12 arranged on the upper surface of fibrous pulp 1 and a substantially cylindrical mating roll 13 positioned below fibrous pulp web 1. The transfer further utilizes a suctioned guide roll 21 that is positioned within, and looped by, an upper press felt 11.

In FIG. 1, a lower press felt 17 may be guided through a second, elongated press nip 10. After second press nip 10, upper press felt 11 may be separated and guided away from fibrous pulp web 1 on lower press felt 17. Fibrous pulp web 1 may be subsequently transferred from lower press felt 17 to a drying screen 16 of a subsequent drying section.

In contrast to lower press felt 17 utilized in the embodiment depicted in FIG. 1, FIG. 2 utilizes a smooth, water impermeable lower belt 15 guided through second press opening 10. Lower belt 15 is provided to substantially prevent remoistening. Remoistening is particularly avoidable because upper press felt 11 can be led away or deflected from fibrous pulp web 1 and lower belt 15 immediately after passing through second press nip 10.

For improved guiding of fibrous pulp web 1 on upper press felt 11, lower belt 15 can be adjustably positioned to bring lower belt 15 toward fibrous pulp web 1 and upper press felt 11. The positioning of lower belt 15 may be achieved via an positionably adjustable guide roll 14 that may be moved vertically moved, i.e., as shown by the bidirectional arrow. As shown, guide roll 14 is positioned within, and looped by, lower belt 15, and guide roll 14 is looped by lower belt 15 before the second press nip 10, with respect to the lower belt travel direction.

In order to suction fibrous pulp web 1 on the upper press felt 11, and to substantially hinder the introduction of air into the intake gusset between upper press felt 11 and upper press shoe roll 12, one or several suction boxes 18 are arranged along the surface of upper press felt 11 opposite fibrous pulp web 1 in front of the intake gusset.

Press shoe rolls 8 and 12 may be composed of a flexible roll sleeve guided over a press shoe having a concave pressing surface. The contact pressure generally occurs hydraulically and the lubrication between the press shoe and the roll sleeve may be hydrostatic and/or hydrodynamic.

The suctioned rolls discussed above may be composed of a perforated roll sleeve so that an internal or interior vacuum may be produced. This vacuum may be produced either through a direct connection with a vacuum source or through an exterior suctioning of an area of the suctioned roll that is not looped by the press felt.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A press section of a machine for manufacturing a fibrous pulp web comprising:

at least one press nip for draining the fibrous pulp web;

at least two continuous press felts, at least one felt positioned on each side of the fibrous pulp web, the at least two continuous press felts being guided through the press nip;

a transfer roll that transfers the fibrous pulp web from a belt of a prepositioned unit to one of the at least two continuous press felts;

a suctioned guide roll arranged within a loop of the one continuous press felt and between the transfer roll and the press nip, the suctioned guide roll being adjustably positionable so that the other of the at least two continuous press felts positioned opposite the one continuous press felt is at least tangential to the suctioned guide roll; and a device for adjustably positioning the suctioned guide roll, whereby adjustable positioning of the suctioned guide roll adjusts an intake angle of the web into the at least one press nip.

2. The press section in accordance with claim 1, the press nip comprising a first press nip of the press section; and the belt being composed of a screen of a prepositioned former.

3. The press section in accordance with claim 1, the one continuous press felt being positioned above the fibrous pulp web to form an upper press felt.

4. The press section in accordance with claim 1, the other of the two continuous press felts being positioned below the fibrous pulp web to form a lower press felt; and the lower press felt adapted to transfer the fibrous pulp web to a subsequent unit.

5. The press section in accordance with claim 4, the press nip comprising an elongated press nip; and the elongated press nip being formed between a shoe press roll and a cylindrical mating roll.

6. The press section in accordance with claim 5, the subsequent unit comprising a second elongated press nip.

7. The press section in accordance with claim 1, the one continuous press felt having a wrap angle around the suctioned guide roll of between approximately 5° and 60°.

8. The press section in accordance with claim 1, the one continuous press felt having a wrap angle around the suctioned guide roll of between approximately 15° and 45°.

9. The press section in accordance with claim 1, the other of the two continuous press felts having a wrap angle around the suctioned guide roll of between approximately 0° and 30°.

10. The press section in accordance with claim 1, the other of the two continuous press felts having a wrap angle around the suctioned guide roll of between approximately 0° and 15°.

11. A press section for a fibrous pulp web production machine comprising:

a transfer roll;

a press roll;

a first press felt;

a second press felt being guided through the press device with the first press felt;

a suctioned guide roll positioned adjacent the first press felt to adjustably position the first press felt relative to the second press felt;

the suctioned guide roll being located between the transfer roll and the press device;

the suctioned guide roll being adjustably positionable such that the second press felt is at least tangential to the suctioned guide roll; and a device for adjustably positioning the suctioned guide roll, whereby positioning of the suctioned guide roll adjusts an intake angle of the web into the press device.

12. The press section in accordance with claim 11, further comprising a guide roll for the second press felt;

the guide roll being positioned ahead of the suctioned guide roll in a travel direction of the second press felt.

13. The press section in accordance with claim 12, the guide roll being positionably adjustable to vary a wrap angle of the second press felt around the suctioned guide roll.

14. The press section in accordance with claim 11, further comprising a subsequent unit comprising a second press device, a third press felt, and a transport belt; and the third press felt and the transport belt being guided through the second press device.

15. The press section in accordance with claim 14, the transport belt comprising a water impermeable belt;

the subsequent unit further comprising a positionable guide roll that guides the water impermeable belt and adjusts the position of the water impermeable belt relative to the third press felt.

16. The press section in accordance with claim 15, further comprising:

at least one suction device positioned along the third press felt and located ahead of the second press device in a travel direction of the third press felt.

17. The press section in accordance with claim 16, further comprising:

a deflection roll positioned to separate the third press felt from the water impermeable belt upon exiting the second press device.

18. The press section in accordance with claim 14, the transport belt comprising a press felt the subsequent unit further comprising a second suctioned guide roll that guides the press felt upon exiting the second press device.

19. The press section in accordance with claim 18, the third press felt and the press felt being guided together between the second press device and the second suctioned guide roll.

20. The press section in accordance with claim 19, further comprising:

a deflection roll positioned to separate the third press felt from the press felt at the second suctioned guide roll.

21. The press section in accordance with claim 14, further comprising at least one suction device positioned adjacent the third press felt and ahead of the second press device, in a travel direction of the third press felt.

* * * * *